US012516810B2

(12) United States Patent
Safar et al.

(10) Patent No.: US 12,516,810 B2
(45) Date of Patent: Jan. 6, 2026

(54) FLARE SYSTEMS EMISSIONS ANALYZER

(71) Applicant: Saudi Arabian Oil Company, Dhahran (SA)

(72) Inventors: Anas H. Safar, Dhahran (SA); Mohammed A. Al-Mahmood, Dhahran (SA); Yousef D. Aloufi, Dhahran (SA); Abdullmajeed I. Al Sanad, Dhahran (SA); Mohammed A. Aljallal, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 995 days.

(21) Appl. No.: 17/452,332

(22) Filed: Oct. 26, 2021

(65) Prior Publication Data

US 2023/0128460 A1 Apr. 27, 2023

(51) Int. Cl.
*F23G 5/50* (2006.01)
*F23G 7/08* (2006.01)

(52) U.S. Cl.
CPC ..... *F23G 5/50* (2013.01); *F23G 7/085* (2013.01); *F23G 2207/104* (2013.01); *F23G 2207/105* (2013.01); *F23G 2207/106* (2013.01); *F23G 2209/14* (2013.01)

(58) Field of Classification Search
CPC ... F23G 7/085; F23G 5/50; F23G 7/08; F23G 2209/14; F23G 2207/105; F23G 2207/104; F23G 2207/106; G01N 33/0036; F23N 2223/00; F23N 2900/05002; F23N 2900/05003
See application file for complete search history.

(56) References Cited

U.S. PATENT DOCUMENTS 4,202,168 A 5/1980 Acheson et al.
4,227,872 A * 10/1980 Zink ..... F23N 5/003 431/12
4,233,596 A * 11/1980 Okamoto ..... F23N 5/082 431/14
4,342,550 A * 8/1982 Tuck ..... F23G 7/085 431/5
4,505,668 A 3/1985 DiBiano et al.
(Continued)

FOREIGN PATENT DOCUMENTS

EP 2309186 4/2011
EP 2330347 6/2011
WO WO 2015094578 A1 6/2015

OTHER PUBLICATIONS

PCT International Search Report and Written Opinion in International Appln. No. PCT/US2022/077028, dated Jan. 23, 2023, 12 pages.

(Continued)

*Primary Examiner* — Shogo Sasaki
(74) *Attorney, Agent, or Firm* — Fish & Richardson P.C.

(57) ABSTRACT

Systems and methods include a computer-implemented method for monitoring emissions in real time. Flaring emissions are determined in real time for a flare stack based on: 1) a flaring volume in conjunction with heat and material balances of systems that discharge to a flare system, and 2) a composition of each relief source that discharges to the flare system. A molar balance around the flare stack is performed in real time using the flaring emissions to determine the emissions.

20 Claims, 5 Drawing Sheets

(56) References Cited

U.S. PATENT DOCUMENTS

| | | | | |
|---|---|---|---|---|
| 8,138,927 | B2 * | 3/2012 | Diepenbroek | F23N 5/082 431/79 |
| 8,629,313 | B2 * | 1/2014 | Hong | F23G 5/50 431/5 |
| 8,967,995 | B1 | 3/2015 | Griffin et al. | |
| 9,594,359 | B2 * | 3/2017 | Mohideen | G05B 17/02 |
| 9,677,762 | B2 * | 6/2017 | Tullos | F23G 7/085 |
| 10,000,704 | B2 * | 6/2018 | Young | F25J 3/08 |
| 10,029,291 | B2 | 7/2018 | Fischer et al. | |
| 11,795,810 | B2 * | 10/2023 | Safar | F23G 7/08 |
| 11,859,815 | B2 * | 1/2024 | Al-Shaiji | F23G 7/085 |
| 2003/0069743 | A1 | 4/2003 | Nordrum | |
| 2010/0070404 | A1 | 3/2010 | McConnell | |
| 2014/0266740 | A1 | 9/2014 | Fernandes et al. | |
| 2015/0260397 | A1 | 9/2015 | Talasila et al. | |
| 2017/0292077 | A1 * | 10/2017 | Young | F25J 3/0242 |
| 2017/0370579 | A1 | 12/2017 | Johnson et al. | |
| 2019/0242575 | A1 | 8/2019 | Fisher et al. | |
| 2019/0366400 | A1 | 12/2019 | Chambers et al. | |
| 2020/0386404 | A1 | 12/2020 | Kraus et al. | |
| 2021/0372864 | A1 | 12/2021 | Tao et al. | |
| 2023/0094678 | A1 * | 3/2023 | Safar | F23G 7/08 431/5 |
| 2023/0096405 | A1 | 3/2023 | Safar et al. | |
| 2024/0011632 | A1 | 1/2024 | Safar et al. | |

OTHER PUBLICATIONS

PCT International Search Report and Written Opinion in International Appln. No. PCT/US2023/026336, dated Oct. 10, 2023, 12 pages.

bakerhughesds.com [online], "Flare gas measurement & control solutions," 2021, retrieved Aug. 9, 2021 from URL<https://www.bakerhughesds.com/panametrics/flare-management>, 11 pages.

Boneu et al., "How and when to monitor a patient treated with low molecular weight Heparin," Seminars in Thrombosis and Hemostasis, Oct. 2001, 27(5):519-522, 4 pages.

Compendium of Greenhouse Gas Emissions Methodologies for the Oil and Natural Gas Industry, American Petroleum Institute, Aug. 2009, 807 pages.

Eddleman et al., "Flare monitoring regulatory compliance and analyzers: An analysis," Yokogawa, 2018, 4 pages.

Gilmer et al., "Draft flare waste gas flow rate and composition measurement methodologies evaluation document," Texas Commission on Environmental Quality, Work Assignment 5, Shell Global Solutions, available on or before Jun. 2013 via Internet Archive Wayback Machine URL<https://web.archive.org/web/20131101000000*/https://www.tceq.texas.gov/assets/public/implementation/air/am/contracts/reports/oth/FLARE_WASTE_GAS_FLOW_RATE.pdf>, 141 pages.

Mandatory Greenhouse Gas Reporting, 40 CFR § 98, Chapter I, Subchapter C, Oct. 2009, 581 pages.

Moorman et al., "Lower heating value sensor for fuel monitoring," IEEE Sensors, 2005, 802-805.

sick.com [online], "Gas flow measuring instruments FLOWSIC100 Flare," 2021, retrieved Aug. 9, 2021 from URL<https://www.sick.com/th/en/flow-measurement-technology/gas-flow-measuring-instruments/flowsic 100-flare/c/g198253>, 7 pages.

Thermofisher.com [online], "Flare stack emission monitoring," Available on or before May 4, 2021, via Internet Archive Wayback Machine URL <https://web.archive.org/web/20210420073913/https://www.thermofisher.com/us/en/home/industrial/manufacturing-processing/flare-stack-emission-monitoring.html>, retrieved on Oct. 12, 2021, retrieved from URL <https://www.thermofisher.com/sa/en/home/industrial/manufacturing-processing/flare-stack-emission-monitoring.html>, 4 pages.

Zeng et al., "Validation of a new method for measuring and continuously monitoring the efficiency of industrial flares," Journal of the Air & Waste Management Association, 2016, 66(1):76-86, 12 pages.

Engineering Data Book, The Gas Processor Suppliers Association (GPSA), 12th Edition, vol. 1, Chapter 5: Relief Systems, 2004, 25 pages.

Sick, "Flowsic100 Flare: Reliable gas flow measurement in flare gas applications," Oct. 2021, retrieved Jul. 13, 2022, retrieved from URL <https://www.bakerhughesds.com/panametrics/sensors-probes-transducers-transmitters/oil-and-gas/panametrics-flare>, 5 pages.

Umukoro et al., "Modelling emissions from natural gas flaring," Journal of King Saud University—Engineering Sciences, 2017, 29:178-182, 5 pages.

PCT International Search Report and Written Opinion in International Appln. No. PCT/US2022/077030, dated Jan. 30, 2023, 14 pages.

PCT International Search Report and Written Opinion in International Appln. No. PCT/US2022/078596, dated Feb. 2, 2023, 15 pages.

* cited by examiner

FLARE SYSTEMS EMISSIONS ANALYZER

TECHNICAL FIELD

The present disclosure applies to monitoring and controlling flare systems.

BACKGROUND

Flare systems include gas flares (or flare stacks) that provide gas combustion at industrial plants such as at onshore and offshore oil and gas production sites. Flare systems can provide venting during start-up or shut-down, and for handling emergency releases from safety valves, blow-down, and de-pressuring systems.

SUMMARY

The present disclosure describes techniques that can be used for analyzing flare systems emissions. In some implementations, a computer-implemented method includes the following. Flaring emissions are determined in real time for a flare stack based on: 1) a flaring volume in conjunction with heat and material balances of systems that discharge to a flare system, and 2) a composition of each relief source that discharges to the flare system. A molar balance around the flare stack is performed in real time using the flaring emissions to determine the emissions.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Using techniques of the present disclosure can eliminate limitations in reading range common to commercially available alternatives, which are designed with specific ranges of operation. The techniques can help to measure and monitor the life-stream of each flare header. Combustible fluid losses can be reduced (improving de-carbonization by implementing techniques that result in emitting less carbon to the environment). The accuracy of emissions calculations for sulfuric dioxide ($SO_2$), nitrogen dioxide ($NO_2$), carbon dioxide ($CO_2$), and methane ($CH_4$) can be improved. The monitoring and reporting of greenhouse gas (GHG) emissions can be automated. Techniques of the present disclosure can aid operators in conducting a thorough analysis of flaring events as real-time emissions calculations are available. Techniques of the present disclosure can be non-intrusive and can provide cost-effective, real-time estimations of flare system compositions, including flare system GHG emissions, with zero capital expenditures (CAPEX) and operating expenses (OPEX) costs. This can overcome limitations in conventional systems related to measuring range and requiring frequent calibration and maintenance. Also, conventional systems can have limitations of not being an online solution, requiring that readings occur during discrete periods of time. The techniques of the present disclosure have no limitations in reading range and require no maintenance, which can result in ensuring accurate results at all times. Facilities can measure and monitor emissions for each flare header without requiring the installation of an analyzer. The techniques of the present disclosure overcome limitations in conventional systems that do not disclose heat/material balances of systems that discharge to a flare system to determine flare emissions. The techniques can be used to implement systems that are able to determine GHG and $SO_2$ emissions for a flare system.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for analyzing flare systems emissions. Various modifications, alterations, and permutations of the disclosed implementations can be made and will be readily apparent to those of ordinary skill in the art, and the general principles defined may be applied to other implementations and applications, without departing from the scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

The present disclosure relates to computing flaring emissions, for example, sulfuric dioxide ($SO_2$), nitrogen dioxide ($NO_2$), carbon dioxide ($CO_2$), and methane ($CH_4$) for a flare stack based on: 1) the flaring volume in conjunction with heat/material balances of systems that discharge to the flare system, and 2) the composition of each relief source that discharges to the flare system. A molar balance around the flare stack is performed to determine the emissions. Input data may be received, and calculations performed in real time. The determined emissions may be reported (for example, in real time) to operators, and in response, the operators may adjust operation of the systems (that discharge to the flare) to alter the flaring emissions.

A flare systems emissions analyzer is a solution that has the capability to compute the actual flaring emissions of $SO_2$, $NO_2$, $CO_2$, and $CH_4$ for each flare stack. Techniques of the present disclosure can include receiving real-time data from each processing facility's flaring volumes. The data can be analyzed in conjunction with the heat and material balance of the processing facilities and the composition of each relief source connected to the flare system. Results of the analysis can be used to perform a comprehensive molar balance around the flare stack and to determine the emissions with high accuracy. The results of the analysis can be provided to operators in the form of reports that indicate the average daily emissions, providing a real-time display for tracking purposes. The reports and displays can aid operators in tracking and reducing gas emissions at the flare system.

Figure 1:
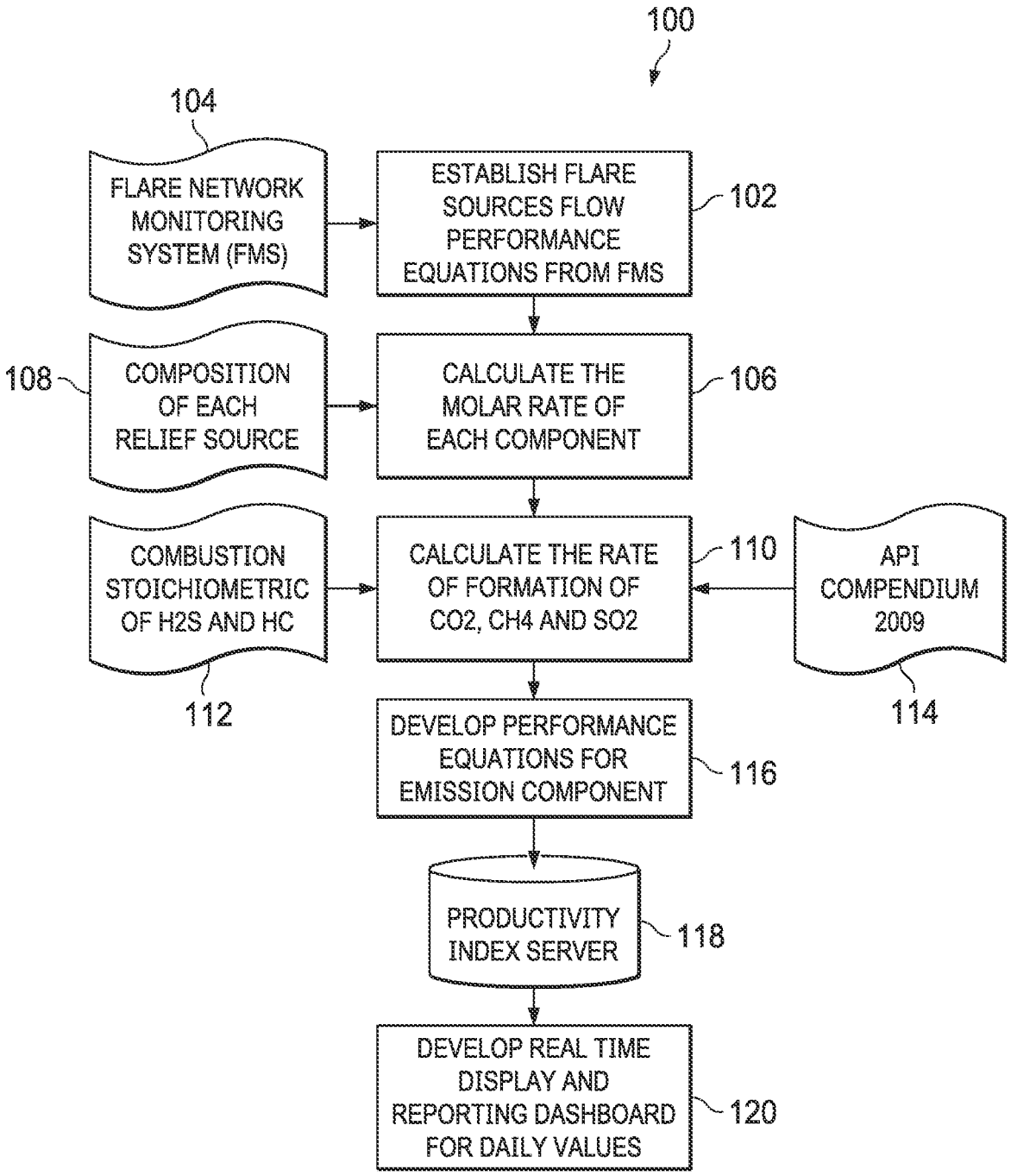
FIG. 1 is a flow diagram showing an example workflow for generating a real-time display, according to some implementations of the present disclosure.

FIG. 1 is a flow diagram showing an example workflow 100 for generating a real-time display, according to some implementations of the present disclosure. At 102, flare sources flow performance equations are established from flare network monitoring system (FMS) 104. This includes determining volumetric flow rates of each relief source from the FMS and determining discharge compositions of each relief source connected to the flare network. At 106, the molar rate of each component is determined using the flare sources flow performance equations determined in step 102 and using the composition of each relief source 108. Determining the molar rates can include, for example, calculating the corresponding molar and mass flow for each component at 14.7 pounds per square inch absolute (psia) and 60 degrees Fahrenheit (° F.). Using a standard pressure and temperature can ensure that the calculations are performed under standard conditions. At 110, rates of formations of $CO_2$, $CH_4$, and $SO_2$, are determined for each flare stack. The calculations can be made using combustion stoichiometrics 112 of hydrogen sulfide (H2S) and hydrocarbons (HC) and based on the 2009 American Petroleum Institute (API) Compendium. At 114, mass balance is conducted for each component. At 116, performance equations are developed for each component and stored on a performance indicator (PI) server 118. At 120, a real-time display and reporting dashboard is developed, using the PI server 118, to view daily values. In some implementations, the PI server can be part of a PI system that provides operation insights, enabling digital transformation through trusted, high-quality operations data.

The combustion stoichiometric coefficients can be used for the formation of $SO_2$ and $CO_2$ to calculate the rate of formation:

$$HC_i + aO_2 \rightarrow bCO_2 + cH_2O \quad (1)$$

$$H_2S + \frac{1}{2}O_2 \rightarrow SO_2 + H_2O \quad (2)$$

where: HC is a molar flow of component (i), for example, in pound-moles per day (lb-mol/d); a, b, and c are stoichiometric coefficients of combustion reaction (dependent on the hydrocarbon component); $O_2$ is a molar rate of oxygen required for combustion, for example, in lb-mol/d; $H_2S$ is a molar flow of hydrogen sulfide, for example, in lb-mol/d; $CO_2$ is a rate of formation of $H_2S$, for example, in lb-mol/d; and $SO_2$ is a rate of formation of $SO_2$, for example, lb-mol/d. In the term $HC_i$, the component i represents a number of carbons in a given compound. For example, $C_3H_6$ has three carbon atoms, and thus will generate three times more $CO_2$ as compared to $CH_4$.

Using an API Compendium emission methodology (for example, API, Compendium of Green Gas methodologies for Oil and Natural Gas Industry, 2009):

$$E_{CO2} = \text{Volume Flared} \times \text{Molar Volume Conversion} \times \text{MW } CO_2 \times \text{mass conversion} \times \left[\sum\left(\frac{\text{Mole Hydrocarbon}}{\text{mole gas}} \times \frac{A \text{ mole } C}{\text{mole Hydrocarbon}} \times \frac{0.98 \text{ mole } CO_2}{\text{mole } C \text{ consumed}}\right) + \frac{B \text{ Mole } CO_2}{\text{mole gas}}\right] \quad (3)$$

where: Molar Volume Conversion is a conversion from molar volume to mass, for example, at a rate of 379.3 standard cubic feet per pound-mole (scf/lb-mol) or a conversion of 23.685 cubic meters per kilogram-mole ($m^3$/kg-mole); MW $CO_2$ is a $CO_2$ molecular weight; mass conversion is, for example, tons/2204.62 lb or tons/1000 kg; A is a number of moles of carbon for a particular hydrocarbon; and B is a number of moles of $CO_2$ present in the flared gas stream. Note that API Compendium recommends test data or vendor-specific information, such as flare combustion efficiency, for estimating flare emissions from gas streams. This is because this information is of higher quality than the default 98% combustion efficiency:

$$E_{CH4} = V \times CH_4 \text{ Mole fraction} \times \% \text{ residual } CH_4 \times \frac{1}{\text{molar volume conversion}} \times MW_{CH4} \quad (4)$$

where: $E_{CH4}$ is an amount of emissions of $CH_4$ (for example, in lb); V is a volume flared (for example, in scf); % residual $CH_4$ is a non-combusted fraction of flared stream (for example, with a default of 0.5% or 2%); molar volume conversion is a conversion from molar volume to mass, (for example, 379.3 scf/lb-mole or a conversion of 23.685 m3/kg-mole); and $MW_{CH4}$ is a $CH_4$ molecular weight. Note that because API Compendium indicates that flare systems have a combustion efficiency greater than 98%, the % residual $CH_4$ can be set at a default of 2% as a conservative measure. Then, based on Equation (4):

$$E_{N_2O} = V \times EF_{N_2O} \quad (5)$$

where: $E_{N2O}$ is an amount of emissions of $N_2O$; V is a volume produced or refined ($m^3$, scf, or barrels (bbl)); and $EF_{N2O}$ is an $N_2O$ emission factor (for example, set to a value based on environmental protection data). A performance equation (PI Expiration) can use the previously described equations to create PI tags in the PI server. The PI Tags can be used for a real-time display of the facility and a monitoring dashboard to illustrate and monitor actual flaring compositions.

Techniques of the present disclosure can be used to provide a detailed breakdown of emissions at the device level. By identifying high-intensive emissions sources, operating facilities can effectively conduct root cause analysis and allocate financial resources to reduce the emissions at the source level. Emissions reporting can also be provided on a real-time basis, including identifying daily average values and automatically identifying reasons for the high-emission conditions and events. In some implementations, emissions information can be presented in user interfaces such as described with reference to FIGS. 2 and 3.

Figure 2:
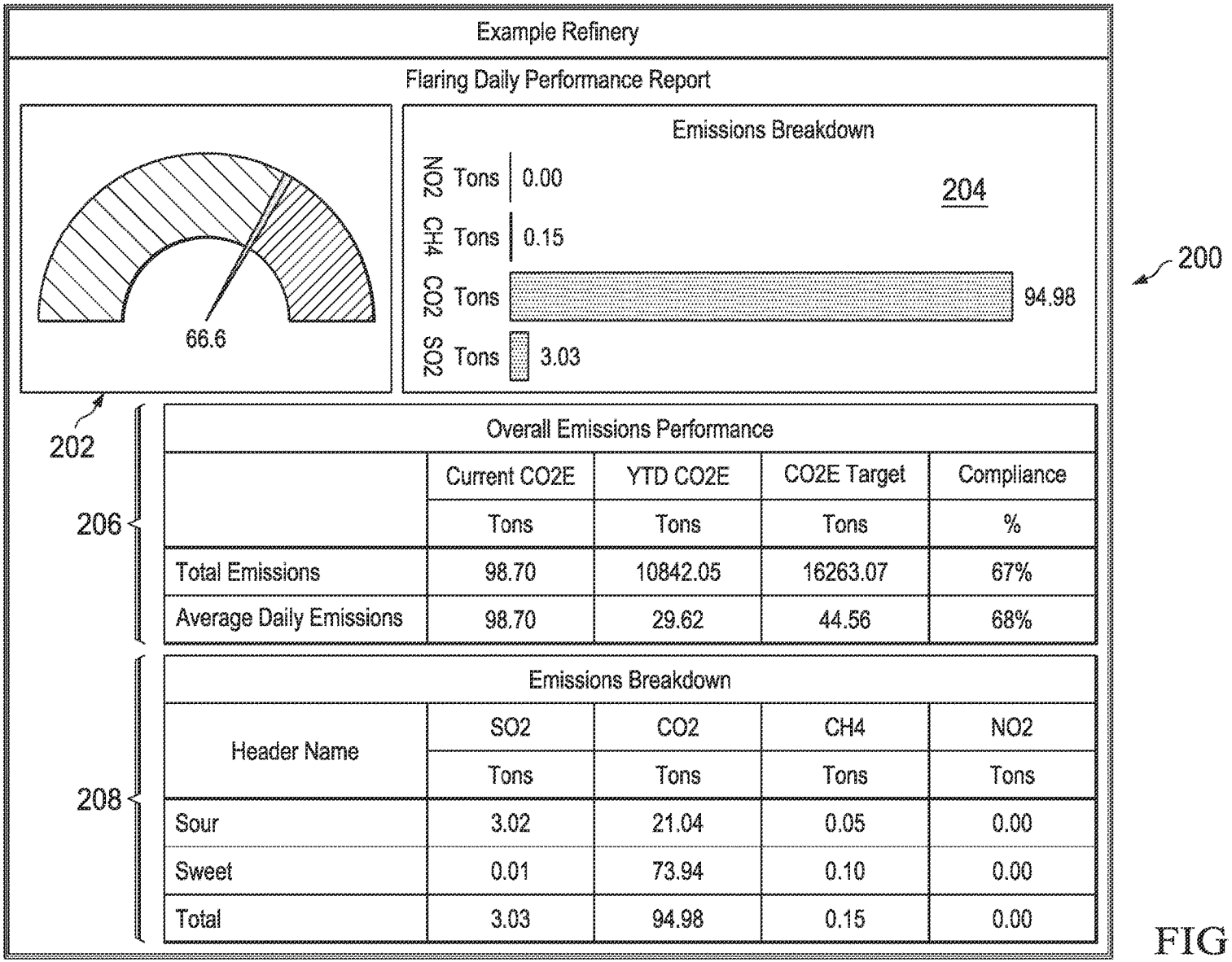
FIG. 2 is a screenshot showing an example of a user interface for reporting flare systems emissions information, according to some implementations of the present disclosure.

FIG. 2 is a screenshot showing an example of a user interface 200 for reporting flare systems emissions information, according to some implementations of the present disclosure. The information can be displayed for a refinery, for example. The user interface includes a refinery emissions score area 202 that displays an overall numeric score for emissions and a meter with a needle indicating a score relative to a low score range and a higher score range. An emissions breakdown area 204 can include a bar graph indicating magnitudes of specific emissions, including $NO_2$, $CH_4$, $CO_2$, and $SO_2$, for example, measured in tons. An overall emissions performance area 206 can present overall emissions for $CO_2$, or CO2e, in categories of current emissions, year-to-date (YTD) emissions, target emissions (for example, in tons)), and a compliance percentage. An emissions breakdown table 208 presents breakdowns of sweet and sour emissions for each of specific emissions, including $SO_2$, $CO_2$, $CH_4$, and $NO_2$, for example, measured in tons. The emissions breakdown table 208 represents each header in the flare system. For example, an operating facility can be equipped with three flare headers. Each flare header can handle sour (low pressure), sweet (high pressure) and sweet-low temperature (high pressure). Therefore, the emissions breakdown table 208 shows the amount of emission for each individual flare header.

Figure 3:
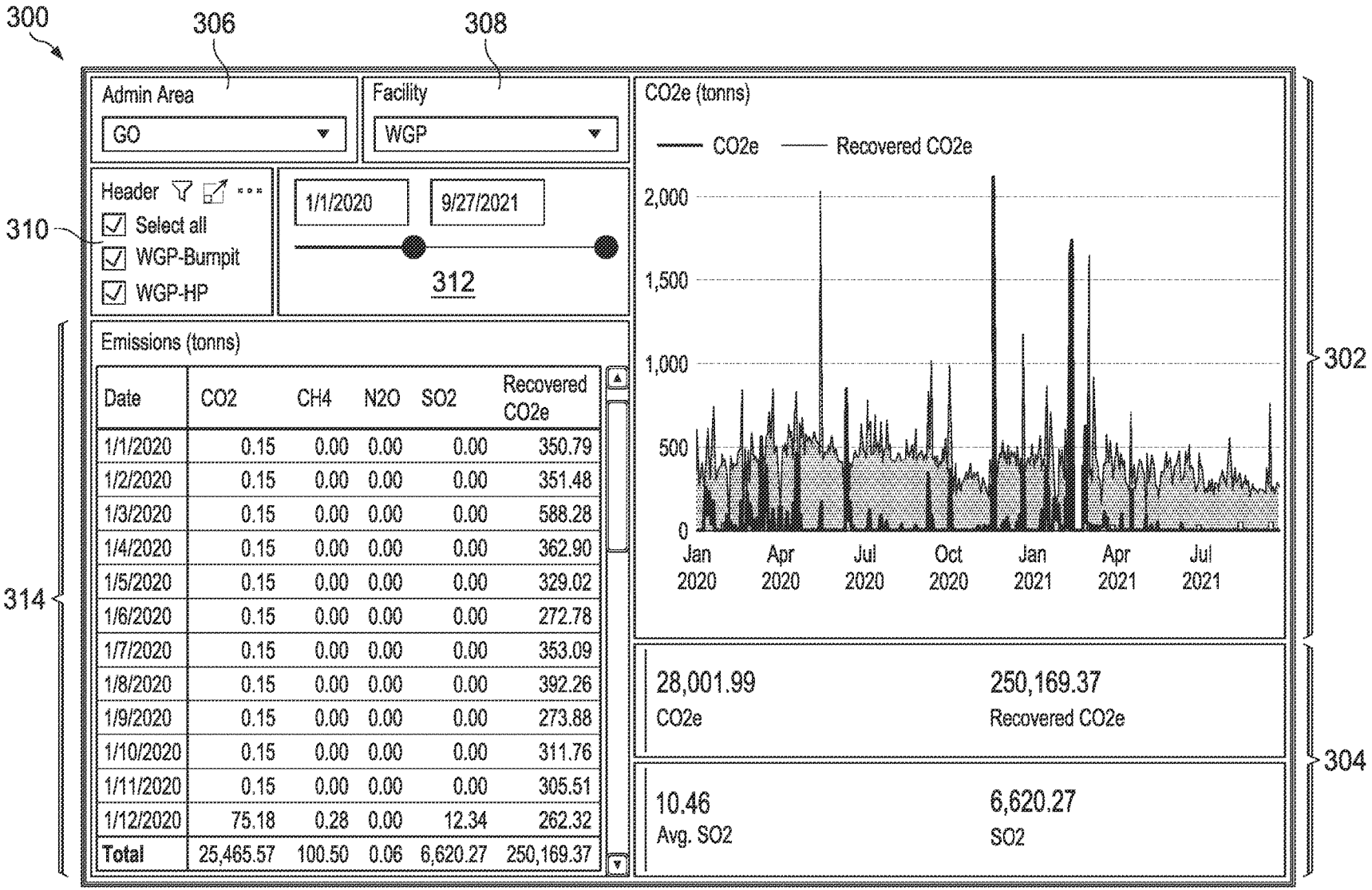
FIG. 3 is a screenshot showing an example of a user interface for reporting carbon dioxide emissions information, according to some implementations of the present disclosure.

FIG. 3 is a screenshot showing an example of a user interface 300 for reporting carbon dioxide emissions information, according to some implementations of the present disclosure. The information can be displayed for different user-selected headers, for example. The user interface includes a $CO_2$ graph area 302 that plots $CO_2$ and recovered $CO_2$ (for example, measured in tons) over time. The plots are plotted relative to a weight axis and a time axis. A statistics area 304 lists cumulative values for $CO_2$, recovered $CO_2$, average $SO_2$, and cumulative $SO_2$. Data that is displayed corresponds to user selections made in an admin area field 306 and a facility field 308. A header selection area 310 facilitates the selection of one or more headers. A time period selection area 312 includes slider controls for defining a time period for which data in the user interface 300 is to be displayed. A daily emissions display area 314 provides a display of daily emissions for $CO_2$, $CH_4$, $NO_2$, $SO_2$, and recovered $CO_2$.

Figure 4:
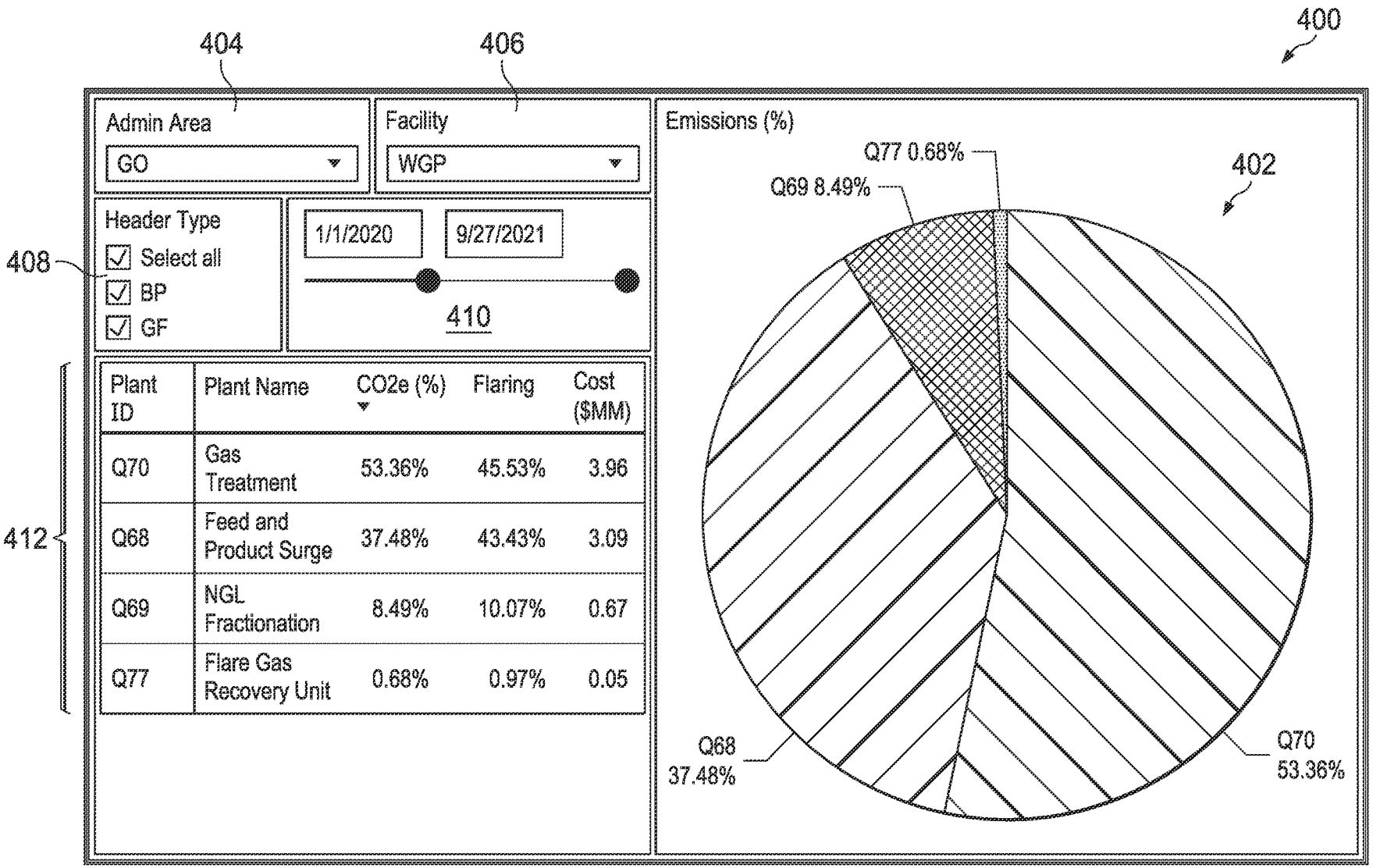
FIG. 4 is a screenshot showing an example of a user interface for reporting emissions information, according to some implementations of the present disclosure.

FIG. 4 is a screenshot showing an example of a user interface 400 for reporting emissions information, according to some implementations of the present disclosure. The information can be displayed for different user-selected headers, for example. The user interface includes a pie chart area 402 that plots a different percentage of contributions to a total emissions by individual plants (for example, Q70, Q68, Q69, and Q77). Data that is displayed corresponds to user selections made in an admin area field 404 and a facility field 406. A header selection area 408 facilitates the selection of one or more headers. A time period selection area 410 includes slider controls for defining a time period for which data in the user interface 400 is to be displayed. A percentage emissions display area 412 provides a display of daily emissions for each plant.

Figure 5:
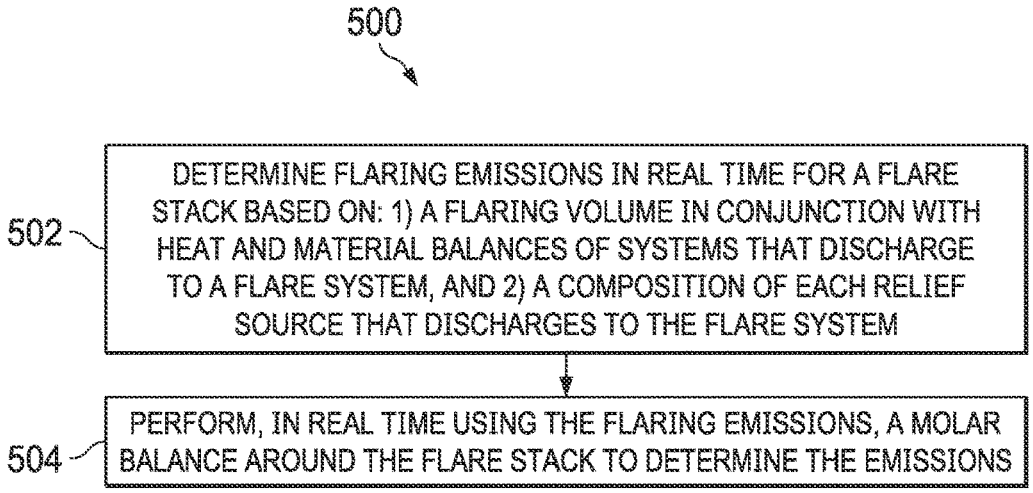
FIG. 5 is a flowchart of an example of a method for computing flaring emissions based on the flaring volumes, heat/material balances of systems discharging to the flare system, and compositions of each relief source, according to some implementations of the present disclosure.

FIG. 5 is a flowchart of an example of a method 500 for computing flaring emissions based on the flaring volumes, heat/material balances of systems discharging to the flare system, and compositions of each relief source, according to some implementations of the present disclosure. For clarity of presentation, the description that follows generally describes method 500 in the context of the other figures in this description. However, it will be understood that method 500 can be performed, for example, by any suitable system, environment, software, and hardware, or a combination of systems, environments, software, and hardware, as appropriate. In some implementations, various steps of method 500 can be run in parallel, in combination, in loops, or in any order.

At 502, flaring emissions are determined in real time for a flare stack. Based on: 1) a flaring volume in conjunction with heat and material balances of systems that discharge to a flare system, and 2) a composition of each relief source that discharges to the flare system. For example, emissions can be determined as described with reference to Equations (1) to (5). From 502, method 500 proceeds to 504.

At 504, a molar balance around the flare stack is performed in real time using the flaring emissions to determine the emissions. Performing the molar balance can include determining a molar and mass flow for each emission in the set of emissions using a standard pressure (for example, 14.7 psia) and a standard pressure (for example, 60° F.). Determining flaring emissions includes computing hourly flaring emissions for each emission in a set of emissions including sulfuric dioxide ($SO_2$), nitrogen dioxide ($NO_2$), carbon dioxide ($CO_2$), and methane ($CH_4$). Determining the emissions for $SO_2$ and $CO_2$ can be based on combustion stoichiometric coefficients for calculating a rate of formation of $SO_2$ and $CO_2$, for example. Determining the emissions for $NO_2$ and $CH_4$ can be based on American Petroleum Institute (API) Compendium emission methodologies, for example. After 504, method 500 can stop.

In some implementations, method 500 further includes a process for reporting emissions to a user and using inputs from the user to make adjustments to the flaring system. For example, the determined emissions can be provided in a report displayed to an operator in real time. Input can be received from the operator for an adjustment to be made to operation of the flaring system. Operation of the flaring system can be adjusted using the input received from the operator. The process for reporting emissions can include a display that the user/operator uses to monitor the process from the display, without adjusting the values used in operations. In some implementations, the adjustments can be made from the process facility system. The changes can be can monitored in real time using the user interface 200.

In some implementations, in addition to (or in combination with) any previously-described features, techniques of the present disclosure can include the following. Customized user interfaces can present intermediate or final results of the above described processes to a user. The presented information can be presented in one or more textual, tabular, or graphical formats, such as through a dashboard. The information can be presented at one or more on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change or an improvement in drilling parameters (including speed and direction) or overall production of a gas or oil well. The suggestions, when implemented by the user, can improve the speed and accuracy of calculations, streamline processes, improve models, and solve problems related to efficiency, performance, safety, reliability, costs, downtime, and the need for human interaction. In some implementations, the suggestions can be implemented in real-time, such as to provide an immediate or near-immediate change in operations or in a model. The term real-time can correspond, for example, to events that occur within a specified period of time, such as within one minute or within one second. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 6:
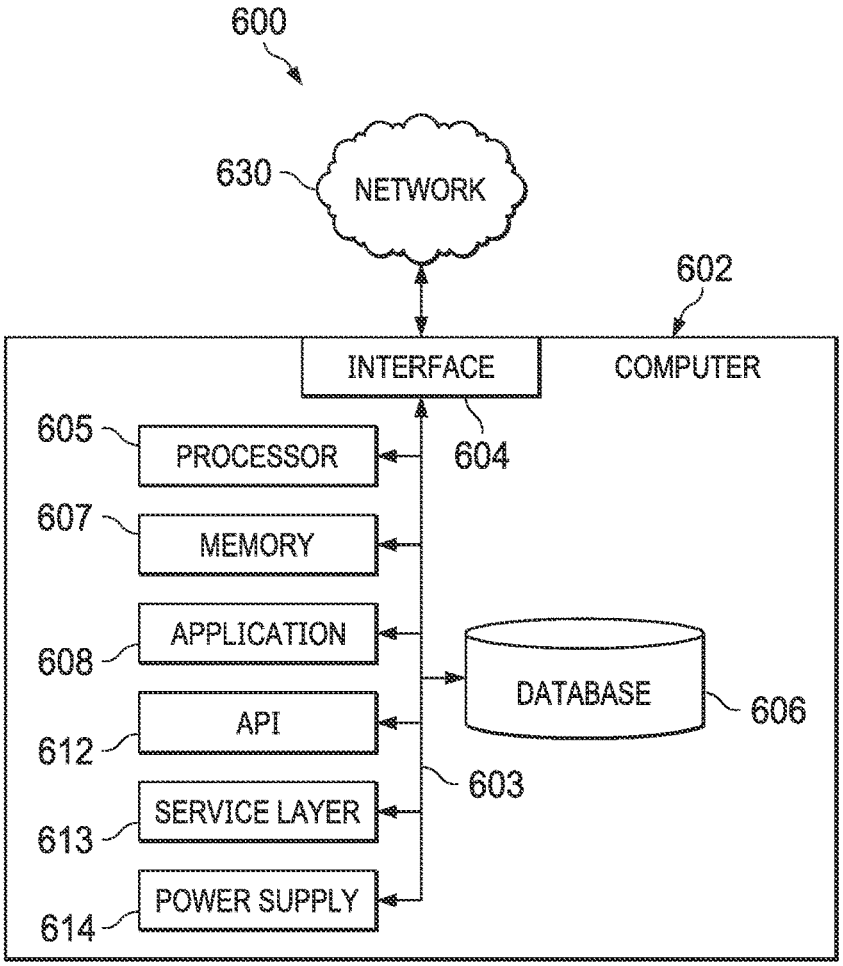
FIG. 6 is a block diagram illustrating an example computer system used to provide computational functionalities associated with described algorithms, methods, functions, processes, flows, and procedures as described in the present disclosure, according to some implementations of the present disclosure.

FIG. 6 is a block diagram of an example computer system 600 used to provide computational functionalities associated with described algorithms, methods, functions, processes, flows, and procedures described in the present disclosure, according to some implementations of the present disclosure. The illustrated computer 602 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI).

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a top-level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both) over the system bus 603. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs.

The service layer 613 can provide software services to the computer 602 and other components (whether illustrated or not) that are communicably coupled to the computer 602. The functionality of the computer 602 can be accessible for all service consumers using this service layer. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 includes an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and can manipulate data to perform the operations of the computer 602, including operations using algorithms, methods, functions, processes, flows, and procedures as described in the present disclosure.

The computer 602 also includes a database 606 that can hold data for the computer 602 and other components connected to the network 630 (whether illustrated or not). For example, database 606 can be an in-memory, conventional, or a database storing data consistent with the present disclosure. In some implementations, database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

The application 608 can be an algorithmic software engine providing functionality according to particular needs, desires, or particular implementations of the computer 602 and the described functionality. For example, application 608 can serve as one or more components, modules, or applications. Further, although illustrated as a single application 608, the application 608 can be implemented as multiple applications 608 on the computer 602. In addition, although illustrated as internal to the computer 602, in alternative implementations, the application 608 can be external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power supply 614 can include a power plug to allow the computer 602 to be plugged into a wall socket or a power source to, for example, power the computer 602 or recharge a rechargeable battery.

There can be any number of computers 602 associated with, or external to, a computer system containing computer 602, with each computer 602 communicating over network 630. Further, the terms "client," "user," and other appropriate terminology can be used interchangeably, as appropriate, without departing from the scope of the present disclosure. Moreover, the present disclosure contemplates that many users can use one computer 602 and one user can use multiple computers 602.

Described implementations of the subject matter can include one or more features, alone or in combination.

For example, in a first implementation, a computer-implemented method includes the following. Flaring emissions are determined in real time for a flare stack based on: 1) a flaring volume in conjunction with heat and material balances of systems that discharge to a flare system, and 2) a composition of each relief source that discharges to the flare system. A molar balance around the flare stack is performed in real time using the flaring emissions to determine the emissions.

The foregoing and other described implementations can each, optionally, include one or more of the following features:

A first feature, combinable with any of the following features, where computing flaring emissions includes computing hourly flaring emissions for each emission in a set of emissions comprising sulfuric dioxide ($SO_2$), nitrogen dioxide ($NO_2$), carbon dioxide ($CO_2$), and methane ($CH_4$).

A second feature, combinable with any of the previous or following features, where performing the molar balance includes determining a molar and mass flow for each emission in the set of emissions using a standard pressure and a standard pressure.

A third feature, combinable with any of the previous or following features, where the standard pressure is 14.7 pounds per square inch absolute (psia), and the standard temperature is 60 degrees Fahrenheit (° F.).

A fourth feature, combinable with any of the previous or following features, where determining the emissions for $SO_2$ and $CO_2$ is based on combustion stoichiometric coefficients for calculating a rate of formation of $SO_2$ and $CO_2$.

A fifth feature, combinable with any of the previous or following features, where determining the emissions for $NO_2$ and $CH_4$ is based on American Petroleum Institute (API) Compendium emission methodologies.

A sixth feature, combinable with any of the previous or following features, the method further including: providing, in real time, the determined emissions in a report displayed to an operator; receiving input from the operator for an adjustment to be made to operation of the flaring system; and adjusting operation of the flaring system using the input received from the operator.

In a second implementation, a non-transitory, computer-readable medium stores one or more instructions executable by a computer system to perform operations, including the following. Flaring emissions are determined in real time for a flare stack based on: 1) a flaring volume in conjunction with heat and material balances of systems that discharge to a flare system, and 2) a composition of each relief source that discharges to the flare system. A molar balance around the flare stack is performed in real time using the flaring emissions to determine the emissions.

The foregoing and other described implementations can each, optionally, include one or more of the following features:

A first feature, combinable with any of the following features, where computing flaring emissions includes computing hourly flaring emissions for each emission in a set of emissions comprising sulfuric dioxide ($SO_2$), nitrogen dioxide ($NO_2$), carbon dioxide ($CO_2$), and methane ($CH_4$).

A second feature, combinable with any of the previous or following features, where performing the molar balance includes determining a molar and mass flow for each emission in the set of emissions using a standard pressure and a standard pressure.

A third feature, combinable with any of the previous or following features, where the standard pressure is 14.7 pounds per square inch absolute (psia), and the standard temperature is 60 degrees Fahrenheit (° F.).

A fourth feature, combinable with any of the previous or following features, where determining the emissions for $SO_2$ and $CO_2$ is based on combustion stoichiometric coefficients for calculating a rate of formation of $SO_2$ and $CO_2$.

A fifth feature, combinable with any of the previous or following features, where determining the emissions for $NO_2$ and $CH_4$ is based on American Petroleum Institute (API) Compendium emission methodologies.

A sixth feature, combinable with any of the previous or following features, the operations further including: providing, in real time, the determined emissions in a report displayed to an operator; receiving input from the operator for an adjustment to be made to operation of the flaring system; and adjusting operation of the flaring system using the input received from the operator.

In a third implementation, a computer-implemented system includes one or more processors and a non-transitory computer-readable storage medium coupled to the one or more processors and storing programming instructions for execution by the one or more processors. The programming instructions instruct the one or more processors to perform operations, including the following. Flaring emissions are determined in real time for a flare stack based on: 1) a flaring volume in conjunction with heat and material balances of systems that discharge to a flare system, and 2) a composition of each relief source that discharges to the flare system. A molar balance around the flare stack is performed in real time using the flaring emissions to determine the emissions.

The foregoing and other described implementations can each, optionally, include one or more of the following features:

A first feature, combinable with any of the following features, where computing flaring emissions includes computing hourly flaring emissions for each emission in a set of emissions comprising sulfuric dioxide ($SO_2$), nitrogen dioxide ($NO_2$), carbon dioxide ($CO_2$), and methane ($CH_4$).

A second feature, combinable with any of the previous or following features, where performing the molar balance includes determining a molar and mass flow for each emission in the set of emissions using a standard pressure and a standard pressure.

A third feature, combinable with any of the previous or following features, where the standard pressure is 14.7 pounds per square inch absolute (psia), and the standard temperature is 60 degrees Fahrenheit (° F.).

A fourth feature, combinable with any of the previous or following features, where determining the emissions for $SO_2$ and $CO_2$ is based on combustion stoichiometric coefficients for calculating a rate of formation of $SO_2$ and $CO_2$.

A fifth feature, combinable with any of the previous or following features, where determining the emissions for $NO_2$ and $CH_4$ is based on American Petroleum Institute (API) Compendium emission methodologies.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, subprograms, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase-change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices, including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touchscreen, or a command-line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for reading and updating. Locking or consistency tracking may not be necessary since the locking of exchange file system can be done at the application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims, as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method, comprising:

determining a flaring volume in conjunction with heat and material balances for each flare header of a flare system comprising a plurality of flare headers, a plurality of relief sources, a flare network monitoring system, and a plurality of flare stacks;

determining a composition of the flaring volume within each relief source that discharges to a respective flare stack of the plurality of flare stacks;

determining volumetric flow rates of each relief source from the flare network monitoring system in real time;

determining, in real time using molar and mass flow for each component of flaring emissions, a molar balance of the flaring emissions of the respective flare stack; and controlling the flaring volume of a respective flare header of the flare system to reduce the flaring emissions of the respective flare stack.

2. The computer-implemented method of claim 1, wherein determining the molar balance of the flaring emissions comprises computing hourly flaring emissions for each emission in a set of emissions comprising sulfuric dioxide ($SO_2$), nitrogen dioxide ($NO_2$), carbon dioxide ($CO_2$), and methane ($CH_4$).

3. The computer-implemented method of claim 2, wherein determining the molar balance comprises determining the molar and mass flow for each emission in the set of emissions using a standard pressure and a standard temperature.

4. The computer-implemented method of claim 3, wherein the standard pressure is 14.7 pounds per square inch absolute (psia), and the standard temperature is 60 degrees Fahrenheit (° F.).

5. The computer-implemented method of claim 2, wherein determining the emissions for $SO_2$ and $CO_2$ is based on combustion stoichiometric coefficients for calculating a rate of formation of $SO_2$ and $CO_2$.

6. The computer-implemented method of claim 2, wherein determining the emissions for $NO_2$ and $CH_4$ is based on American Petroleum Institute (API) Compendium emission methodologies.

7. The computer-implemented method of claim 1, further comprising:

providing, in real time, the flaring emissions in a report; and receiving input from an operator for an adjustment to be made to operation of the flaring system.

8. A non-transitory, computer-readable medium storing one or more instructions executable by a computer system to perform operations comprising:

determining a flaring volume in conjunction with heat and material balances for each flare header of a flare system comprising a plurality of flare headers, a plurality of relief sources, a flare network monitoring system, and a plurality of flare stacks;

determining a composition of the flaring volume within each relief source that discharges to a respective flare stack of the plurality of flare stacks;

determining volumetric flow rates of each relief source from the flare network monitoring system in real time;

determining, in real time using molar and mass flow for each component of flaring emissions, a molar balance of the flaring emissions of the respective flare stack; and controlling the flaring volume of a respective flare header of the flare system to reduce the flaring emissions of the respective flare stack.

9. The non-transitory, computer-readable medium of claim 8, wherein determining the molar balance of the flaring emissions comprises computing hourly flaring emissions for each emission in a set of emissions comprising sulfuric dioxide ($SO_2$), nitrogen dioxide ($NO_2$), carbon dioxide ($CO_2$), and methane ($CH_4$).

10. The non-transitory, computer-readable medium of claim 9, wherein determining the molar balance comprises determining the molar and mass flow for each emission in the set of emissions using a standard pressure and a standard temperature.

11. The non-transitory, computer-readable medium of claim 10, wherein the standard pressure is 14.7 pounds per square inch absolute (psia), and the standard temperature is 60 degrees Fahrenheit (° F.).

12. The non-transitory, computer-readable medium of claim 9, wherein determining the emissions for $SO_2$ and $CO_2$ is based on combustion stoichiometric coefficients for calculating a rate of formation of $SO_2$ and $CO_2$.

13. The non-transitory, computer-readable medium of claim 9, wherein determining the emissions for $NO_2$ and $CH_4$ is based on American Petroleum Institute (API) Compendium emission methodologies.

14. The non-transitory, computer-readable medium of claim 8, the operations further comprising:

providing, in real time, the flaring emissions in a report; and receiving input from an operator for an adjustment to be made to operation of the flaring system.

15. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

determining a flaring volume in conjunction with heat and material balances for each flare header of a flare system comprising a plurality of flare headers, a plurality of relief sources, a flare network monitoring system, and a plurality of flare stacks;

determining a composition of the flaring volume within each relief source that discharges to a respective flare stack of the plurality of flare stacks;

determining volumetric flow rates of each relief source from the flare network monitoring system in real time;

determining, in real time using molar and mass flow for each component of flaring emissions, a molar balance of the flaring emissions of the respective flare stack; and controlling the flaring volume of a respective flare header of the flare system to reduce the flaring emissions of the respective flare stack.

16. The computer-implemented system of claim 15, wherein determining the molar balance of the flaring emissions comprises computing hourly flaring emissions for each emission in a set of emissions comprising sulfuric dioxide ($SO_2$), nitrogen dioxide ($NO_2$), carbon dioxide ($CO_2$), and methane ($CH_4$).

17. The computer-implemented system of claim 16, wherein determining the molar balance comprises determining the molar and mass flow for each emission in the set of emissions using a standard pressure and a standard temperature.

18. The computer-implemented system of claim 17, wherein the standard pressure is 14.7 pounds per square inch absolute (psia), and the standard temperature is 60 degrees Fahrenheit (° F.).

19. The computer-implemented system of claim 16, wherein determining the emissions for $SO_2$ and $CO_2$ is based on combustion stoichiometric coefficients for calculating a rate of formation of $SO_2$ and $CO_2$.

20. The computer-implemented system of claim 16, wherein determining the emissions for $NO_2$ and $CH_4$ is based on American Petroleum Institute (API) Compendium emission methodologies.

* * * * *